US005238362A

United States Patent [19]

Casaro et al.

[11] Patent Number: 5,238,362

[45] Date of Patent: Aug. 24, 1993

[54] TURBOMOLECULAR PUMP

[75] Inventors: Fausto Casaro; Luigi Dolcino, both of Turin, Italy; Mars Hablanian, Wellesley, Mass.; Giampaolo Levi, Turin, Italy

[73] Assignee: Varian Associates, Inc., Palo Alto, Calif.

[21] Appl. No.: 917,564

[22] Filed: Jul. 21, 1992

Related U.S. Application Data

[63] Continuation of Ser. No. 668,525, Mar. 13, 1991, abandoned.

[30] Foreign Application Priority Data

Mar. 9, 1990 [IT] Italy ..... 67163 A/90

[51] Int. Cl.[5] ..... F01D 1/36; F03B 5/00

[52] U.S. Cl. ..... 415/90; 415/143; 415/198.1

[58] Field of Search ..... 415/90, 198.1, 55.1, 415/55.4, 199.1, 143

[56] References Cited

U.S. PATENT DOCUMENTS

| | | | |
|---|---|---|---|
| 4,025,225 | 5/1977 | Durant | 415/90 |
| 4,732,529 | 3/1988 | Narita et al. | 415/90 |
| 4,732,530 | 3/1988 | Veda et al. | 415/90 |
| 4,735,550 | 4/1988 | Okawada et al. | 415/53 T |
| 4,797,062 | 1/1989 | Deters et al. | 415/90 |
| 4,797,068 | 1/1989 | Hayakawa et al. | 417/201 |
| 4,822,251 | 4/1989 | Amrath et al. | 415/90 |
| 4,826,393 | 5/1989 | Miki | 415/72 |
| 5,020,969 | 6/1991 | Mase et al. | 415/55.3 |
| 5,052,887 | 10/1991 | Novikov et al. | 415/90 |
| 5,074,747 | 12/1991 | Ikegami et al. | 415/90 |

FOREIGN PATENT DOCUMENTS

| | | | |
|---|---|---|---|
| 0226039 | 6/1987 | European Pat. Off. . | |
| 3410905 | 10/1985 | Fed. Rep. of Germany | 415/90 |
| 3526517A1 | 2/1986 | Fed. Rep. of Germany . | |
| 3919529A1 | 1/1990 | Fed. Rep. of Germany . | |
| 0159695 | 7/1988 | Japan | 415/90 |

*Primary Examiner*—Thomas E. Denion
*Attorney, Agent, or Firm*—Gerald M. Fisher

[57] ABSTRACT

A high vacuum pump comprising an in-line connection on a single drive shaft of an axial turbomolecular compressor and a peripheral compressor where the pump provides better than $10^{-7}$ Pascal inlet when exhausting to atmosphere. The peripheral compressor has a two stage optimized Gaede design which encloses the impellers in a shroud reducing the top and bottom volume surrounding the impellers and providing a large separation pressure drop region between stages of said peripheral compressors to reduce axial leakage.

4 Claims, 4 Drawing Sheets

TURBOMOLECULAR PUMP

This application is a continuation of application Ser. No. 07/668,525, filed Mar. 13, 1991, now abandoned.

BACKGROUND OF INVENTION

The present invention relates to an improved turbomolecular pump, especially to a turbomolecular pump of increased compression ratio, capable of extending the operating range towards higher pressures.

Conventional turbomolecular pumps usually have large operating ranges from about $10^{-7}$ to $10^{-1}$ or 1 Pascal, however they cannot exhaust directly to atmosphere. This means that they need to be teamed up to a forepump which produces the necessary fore vacuum to discharges the pumped gases at atmospheric pressure. However, contamination of the turbomolecular pump with lubrication oil of the forepump may occur, which prevents pumping at the lower operating range. This may be avoided by maintenance at short intervals, which raises the costs of operation, in addition to a high initial cost of the vacuum system. Moreover, the combination of a turbomolecular pump with a forepump is cumbersome, which is a disadvantage in most applications.

So-called hybrid turbomolecular pumps have also been developed to reduce the necessity of these backing pumps. U.S. Pat. No. 4,732,529, U.S. Pat. No. 4,826,393 and U.S. Pat. No. 4,797,068, disclose turbomolecular pumps including a compression ratio raising section consisting of rotors formed with spiral grooves, or screw rotors, which guide gas from the high vacuum section to a simpler exhaustion system, e.g., to a membrane pump. Although such hybrid turbomolecular pumps do not need complex exhaustion systems consisting of a number of auxiliary vacuum pumps, they still require a forepump, because they are incapable of discharging gases at atmospheric pressure.

A new type of hydrid roughing pump is reported which can reach a roughing pump level of low ultimate pressure ($3\times10^{-2}$ Pascal) J.Vac.Sci.Technol., A, Vol. 6, No. 4, pp. 2518-21, July/August 1988. This reported pump is a turbo vacuum roughing pump comprising radial flow pumping stages consisting of impellers rotating into channels with grooves which direct radially the flow of the pumped gases, and a peripheral flow pumping stage at the exhaust side, which raises the pressure so that the pump can discharge at atmospheric pressure. However, this pump is only a roughing pump that can not replace a turbomolecular pump, the ultimate pressure of which is lower by several orders of magnitudes ($10^{-7}$ Pascal) than the ultimate pressure of this roughing pump ($10^{-2}$ Pascal).

A first object of the present invention is to provide a new hybrid turbomolecular pump with a high compression ratio.

Another object of the present invention is to provide a new hybrid turbomolecular pump which is capable of discharging gases at atmospheric pressure, without being combined with a forepump.

A further object of the present invention is to provide a turbomolecular pump which is relatively simple in comparison with previous vacuum systems having similar operating range.

SUMMARY OF THE INVENTION

For attaining the foregoing objects, an improved turbomolecular pump according to the invention comprises at the suction side a plurality of pumping stages consisting of alternately arranged rotors and stators provided with inclined blades, the rotor blades being inclined in the inverse direction to the stator blades, for pumping gases along an axial flow through said pumping stages, characterized in that it further comprises at least one pumping stage at the exhaust side, consisting of a rotor and a coplanar stator with a free annular channel defined in-between, along a part of their circumferences, said free annular channel being in communication with a suction port and a discharge port for pumping gases with a flow tangential to said rotor from said suction port to said discharge port.

According to another feature of the invention a tangential flow pumping stage may be added in which the rotor consists of a disk provided with blades to enhance the pumping effect in the viscous flow range.

Illustrative embodiments of the invention are hereinafter described in conjunction with the drawings.

DETAILED DESCRIPTION OF A PREFERRED EMBODIMENT

Figure 1:
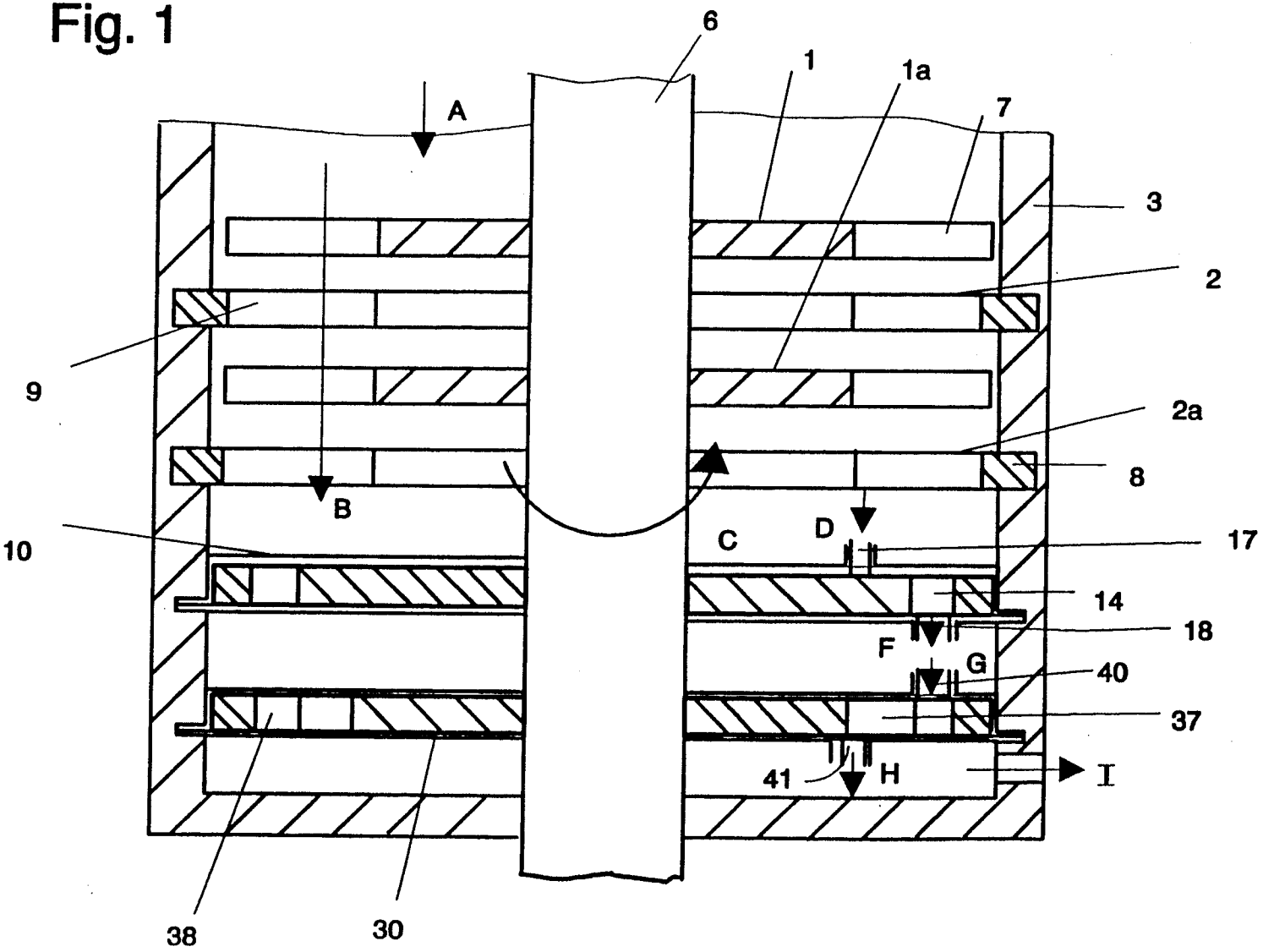
FIG. 1 is a schematic view in axial section of a part of a turbomolecular pump according to the invention.
Figure 2:
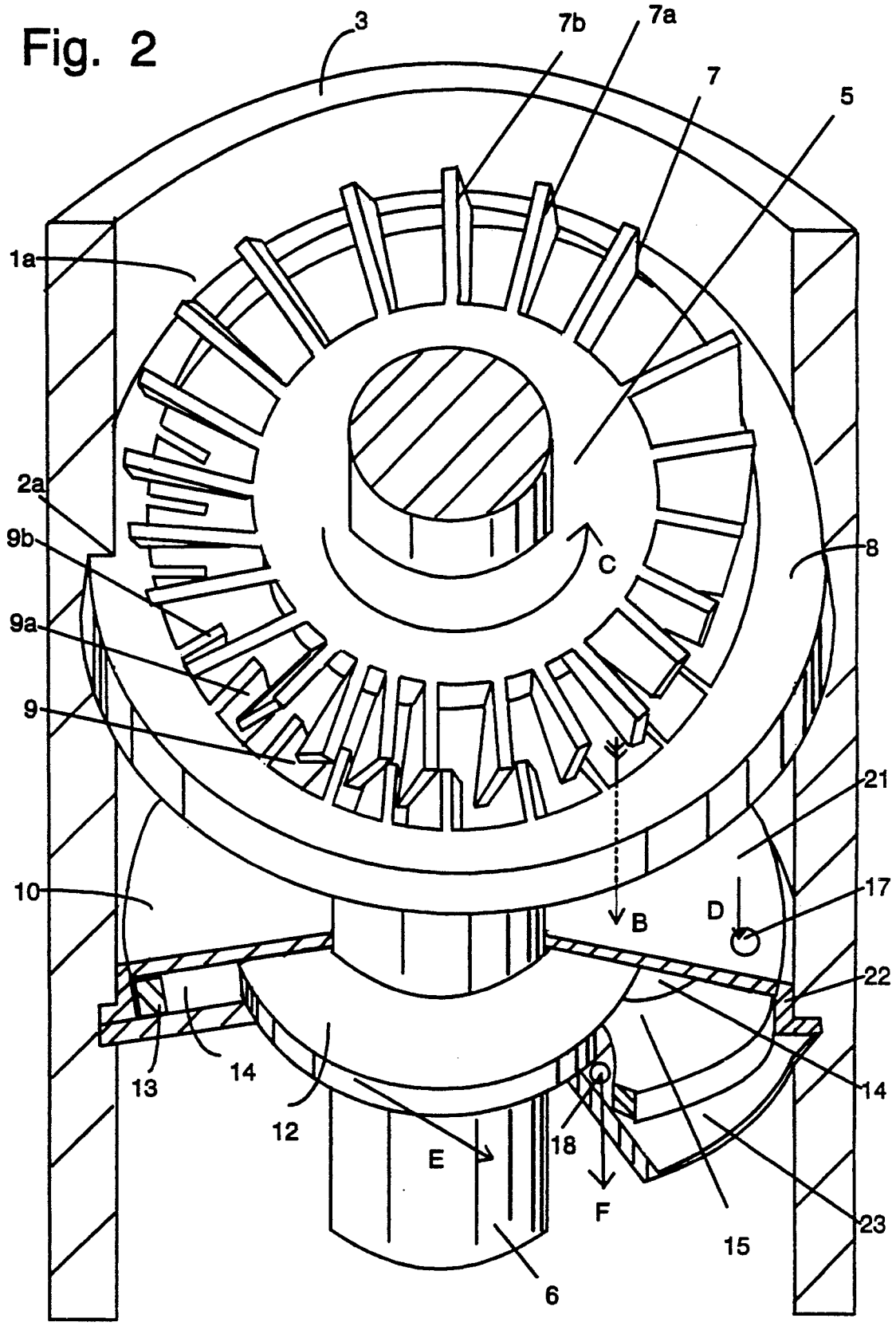
FIG. 2 is a perspective view of part of the pump of FIG. 1, with a partially broken first embodiment of a tangential flow pumping stage.

With reference to FIG. 1, a turbomolecular pump according to the invention comprises a certain number of axial flow pumping stages, each consisting of a rotor 1 or 1*a*, and of a stator 2 or 2*a*, contained in a cylindrical pump body 3, as know in the art. The pumping stage consisting of rotor 1*a* and stator 2*a* is also shown in FIG. 2. Each rotor consists of a disk 5 mounted on a rotatable shaft 6, and carrying at its periphery an array of radially protruding inclined blades 7, 7*a*, 7*b*. Each stator consists of a similar disk with a central hole for the shaft 6 of the rotors. Each stator is fixed to the pump body 3, and consists of a disk 8 provided with blades 9, 9*a*, 9*b*, which are inclined in a direction that is inverse to the direction of the rotor blades 7, 7*a*, 7*b*.

Gases coming from the suction side, not shown but indicated by arrow A, are pumped by the described stages along the direction parallel to the axis of the cylindrical body 3, i.e., an axial flow of gases in produced through the alternate rotors and stators, as indicated by the arrow B of FIG. 1.

According to the invention, one or more pumping stages of different conception are added downstream the axial flow pumping stages.

In FIG. 1 two of such pumping stages are shown, indicated globally with the reference numerals 10 and 30.

Each of the pumping stage 10 and 30 comprises a rotor mounted on shaft 6, and a stator fixed to the pump body 3. Constructional details of these pumping stages are also illustrated in FIGS. 2 to 4.

Figure 3:
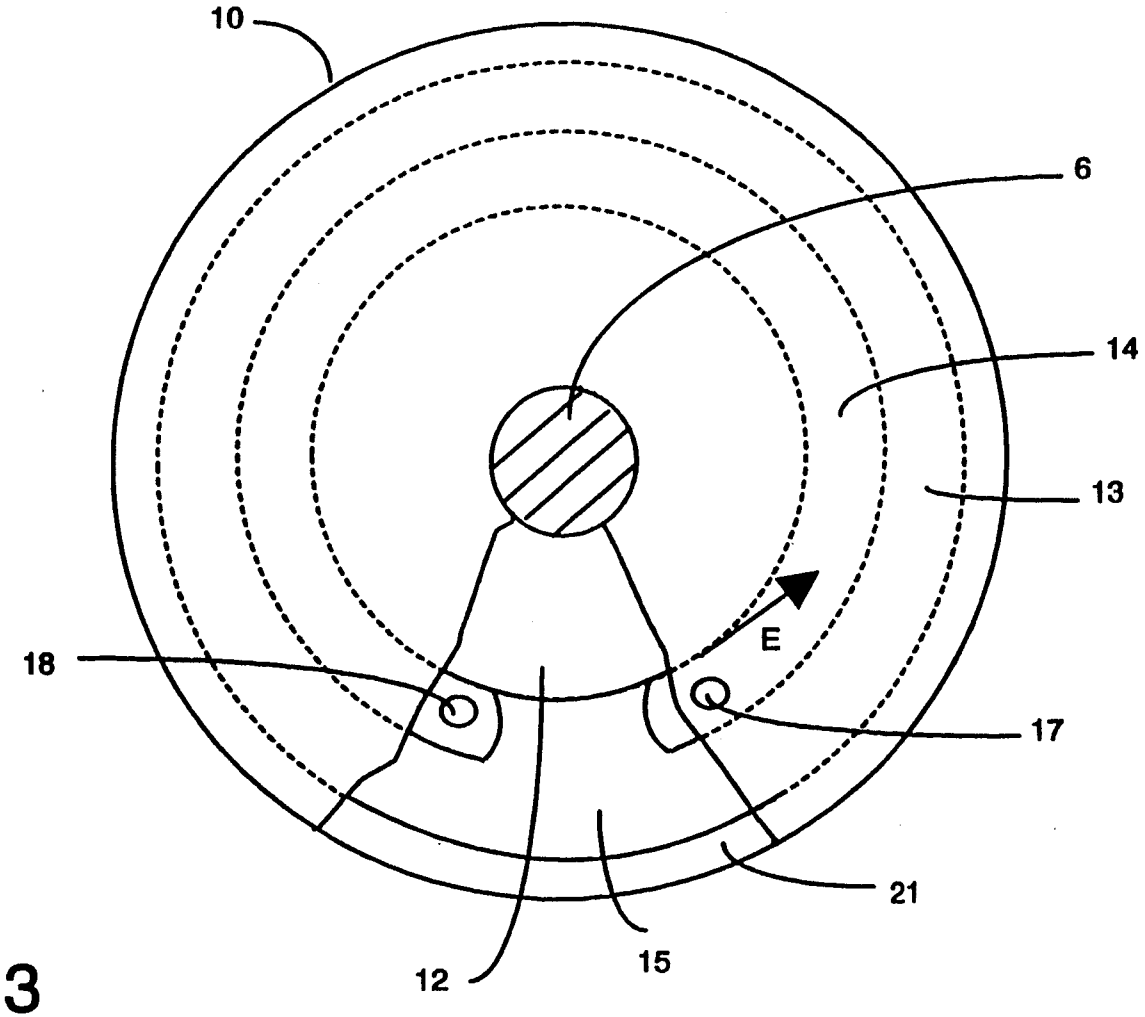
FIG. 3 is a partially broken plane view of a pumping stage of FIG. 2.
Figure 4:
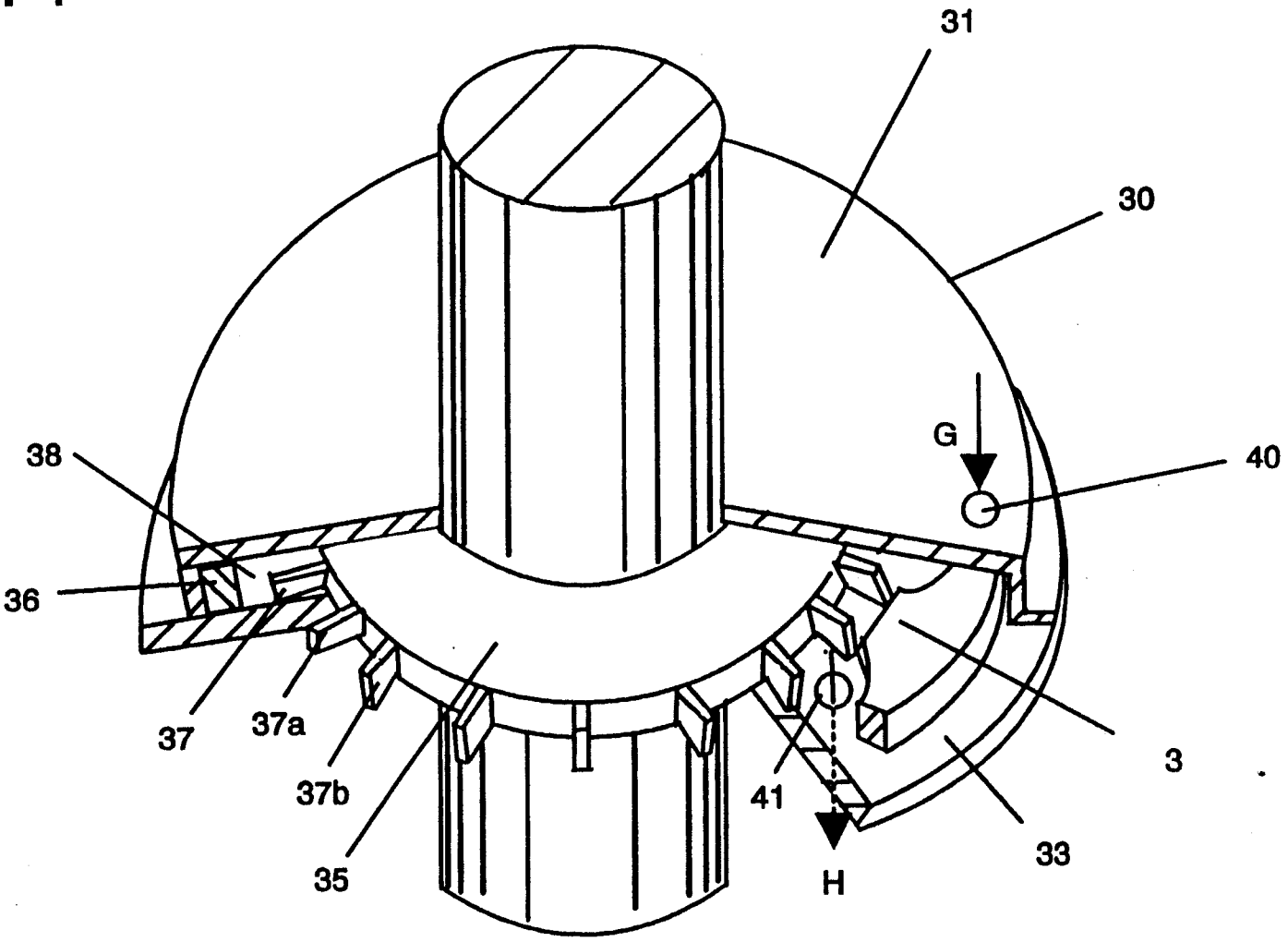
FIG. 4 is a perspective view of a partially broken second embodiment of a tangential flow pumping stage.

With reference to FIGS. 1, 2 and 3, pumping stage 10 comprises a rotor consisting of a plane disk 12 secured to shaft 6. Rotor 12 is encompassed by a substantially coplanar stator having the shape of a ring 13 spaced apart from the rotor disk 12, so that a free annular channel 14 is defined between rotor and stator. A baffle 15 closes channel 14 between a suction port 17 and a discharge port 18, provided in an upper closure plate 21 and in a lower closure plate 23, respectively. Closure plates 21 and 23 are joined together by suitable means, e.g., by connection of downwardly extending edge 22 of plate 21, so as to form a closed casing containing the pumping stage. Central holes are provided in both plate 21 and 23, for the passage of the shaft 6. The baffle 15 may be a radial projection of the stator 13, as shown in FIGS. 2 and 3, or a separate element tightly secured to the stator ring 13.

The operation of the pumping stage above described is as follows.

Gases pumped by the axial flow pumping stages come to suction hole 17, as indicated by arrow D in FIGS. 1 and 2, and enter into channel 14. Here, the gas molecules strike the rotating disk 12 and attain a velocity with a component tangential to the disk 12, as indicated by arrow E. By this process the molecules are transferred within free channel 14 from the suction port 17 to the discharge port 18 according to a tangential flow, and leave channel 14 through discharge port 18, as indicated by arrow F. The flow of gases that is produced in the free channel 14 is referred to as "tangential flow" because it parallel to the direction of the velocity of the rotor, which is a tangent to the rotor.

This tangential flow pumping stage is effective in the molecular and/or transient flow pressure range, and permits raising the outlet pressure from about 1 Pascal, that is the usual outlet pressure of a conventional turbomolecular pump, to $10^3$ Pascal or more. At higher pressure ranges, i.e., in the viscous flow range, pumping stages with plane rotor disks are not effective. It has been found that a different rotor design, such as shown in detail in FIG. 4, can produce a further raising of the outlet pressure, up to atmospheric pressure.

With reference also to FIG. 1, pumping stage 30 is effective in the viscous flow range. Pumping stage 30 is arranged in series, downstream of pumping stage 10. Similar to pumping stage 10, it comprises a closed casing consisting of an upper plate 31 with a downwardly extending edge 32 connected to a lower plate 33. Shaft 6 extends axially in the casing, and carries a rotor disk 35 with peripheral vanes such as 37, 37*a*, 37*b*, lying on planes perpendicular to the plane of disk 35. A coplanar stator ring 36 encompasses rotor 35 but spaced apart from it, so that a free annular channel 38 is defined between the periphery of the vanes of the rotor and the stator. A baffle 39 obstructs the free channel 38 between a suction port 40 made in upper plate 30 and a discharge port 41 made in lower plate 33.

As shown in FIG. 1, gases discharged from port 18 of pumping stage 10 into an expansion chamber between stages 10 and 30 and come to the suction port 40 of the pumping stage 30, as indicated by arrow G, and enter into channel 38 between the rotor and the stator. Here, gas molecules get kinetic energy by striking the rotor, a circular flow with a tangential velocity component is produced in free channel 38, and gases are pumped from suction port 40 to discharge port 41. In this last stage the pressure is raised to about $10^5$ Pascal, so that the pump can exhaust directly to the atmosphere through port 43 in the pump body 3, as indicated by arrow I in FIG. 1.

The peripheral velocity of the rotor of this turbomolecular pump, including both axial and tangential stages, is usually not less than 250 m/s, preferably from 350 to 400 m/s. For example, in a small pump equipped with a rotor having a diameter of 100 mm (0.01 m), the angular velocity of the rotor is 50,000 r.p.m. to obtain a peripheral velocity of 260 m/s ($v_p=2\pi r v_a$). For larger diameters of the rotor, the angular velocity may be lower, provided that the peripheral velocity does not drop below about 250 m/s.

It is apparent from the above description that the number of both the axial flow and the tangential flow pumping stages, either of the type with plane rotor or of the type with vaned rotor, may be varied according to the specific application, without departing form the scope of the invention.

We claim:

1. In an integral high vacuum pump including a generally cylindrical outer pump housing having an axis, an axial turbomolecular compressor and a peripheral compressor, each said compressor having a rotating portion, said rotating portions of both said compressors being coaxial to and coupled to a single high speed motor drive shaft aligned along said axis, the improvement comprising:

said peripheral compressor being a serial combination of a two section pump, said first section being a molecular and transient flow region pump and said second section being a viscous flow pump, whereby the serial combination of said axial flow turbomolecular compressor and said peripheral compressor provide, in operation, an ultimate vacuum pressure of a least $10^{-7}$ Pascal when exhausting at atmosphere pressure;

said first section of said peripheral compressor being completely enclosed and isolated by a first closed casing mounted to said outer pump housing, except for an inlet and exit orifice, and except for leakage at said drive shaft; and said second section of said peripheral compressor being completely enclosed and isolated, by a second closed casing mounted to said outer pump housing except for an inlet and exit orifice, and except for leakage at said drive shaft; and said first and second casings being axially separated by an expansion chamber, said expansion chamber being formed and bounded by said cylindrical outer pump housing, said first closed casing and said second closed casing.

2. In the pump of claim 1 wherein said first section of said peripheral compressor is a Gaede molecular drag structure and wherein said first section is directly coupled to receive gas flow from said axial turbomolecular flow compressor, said Gaede molecular drag structure comprising a rotor disk having an axis, said disk being coaxially mounted to said high speed motor drive shaft, and wherein said first section casing is mounted very closely to said disk above and below said disk, said casing including a free annular channel having a first volume, which annular channel is radially spaced from said disk.

3. The pump of claim 2 wherein said second section of said peripheral compressor is Gaede molecular pump effective in said viscous flow region, wherein said second section is directly coupled to receive gas flow from said first section of said peripheral compressor, said viscous flow effective Gaede molecular pump comprising a second rotor disk having vanes around the periphery which vanes are perpendicular to the plane of the disk and wherein said second section is very closely fitting within said second section casing above and below said second disk, and wherein said second casing includes a free annular channel having a second volume, which annular channel is radially spaced from said second disk.

4. The pump of claim 3 wherein said first and second disk rotors are large enough to achieve a peripheral velocity of at least 250 meters/second for the rotational velocity of said motor drive shift, and wherein said expansion chamber volume is larger than said first or second volume.

* * * * *